United States Patent [19]

Gomersall

[11] 4,285,995

[45] Aug. 25, 1981

[54] PROCESS FOR INCREASING ALLOYING RATE OF GALVANIZED COATING ON STEEL

[75] Inventor: David W. Gomersall, Valparaiso, Ind.

[73] Assignee: Inland Steel Company, Chicago, Ill.

[21] Appl. No.: 128,649

[22] Filed: Mar. 10, 1980

[51] Int. Cl.[3] ..... C23C 1/02

[52] U.S. Cl. ..... 427/383.9; 427/406; 204/37 R; 204/38 S; 428/658; 428/677

[58] Field of Search ..... 427/406, 383.9; 428/658, 676, 677; 204/37 R, 38 S

[56] References Cited

U.S. PATENT DOCUMENTS

| | | | |
|---|---|---|---|
| 213,015 | 3/1879 | Wahl et al. | 427/406 |
| 1,096,636 | 5/1914 | McIlroy | 428/676 |
| 2,115,749 | 5/1938 | Rubin | 428/676 |
| 2,378,458 | 6/1945 | Avallone | 427/406 |
| 2,392,456 | 1/1946 | Brown et al. | 428/676 |
| 2,490,700 | 12/1949 | Wachtman | 428/676 |
| 2,918,722 | 12/1959 | Kenmore | 428/677 |
| 3,762,883 | 10/1973 | Shepard et al. | 428/677 |

FOREIGN PATENT DOCUMENTS

| | | | |
|---|---|---|---|
| 454415 | 9/1936 | United Kingdom | 428/676 |

*Primary Examiner*—Ralph S. Kendall

*Attorney, Agent, or Firm*—Merriam, Marshall & Bicknell

[57] ABSTRACT

A method of increasing the rate of formation of zinc-iron alloy when hot-dip galvanizing a ferrous metal strip to effect complete alloying of the hot-dip zinc coating on at least one side of the strip, wherein a clean ferrous metal strip is provided on at least one lateral surface of the strip with a coating of metallic copper and heating the strip in a non-oxidizing atmosphere to a temperature sufficient to diffuse a portion of the copper coating into the ferrous metal strip (i.e. heating to a temperature between about 724° C. and about 927° C.)and thereafter hot-dip galvanizing the strip. With a very thin hot-dip zinc coating (i.e. having a thickness less than 0.1 mil) no further heating of the strip is necessary in order to provide on at least the one lateral surface a zinc-iron alloy diffusion coating free of unalloyed metallic zinc.

16 Claims, 5 Drawing Figures

PROCESS FOR INCREASING ALLOYING RATE OF GALVANIZED COATING ON STEEL

The present invention relates generally to alloying a galvanized coating on a ferrous metal strip to form a zinc-iron alloy coating and more particularly to a method of transforming a metallic zinc coating on at least one side of a ferrous metal sheet or strip into a surface coating of a zinc-iron alloy and to the product so formed.

Galvanized steel sheet material is widely used where the steel sheet material is exposed to a corrosive atmosphere or other corrosive environment. One important use for corrosion resistant galvanized steel sheet material is in the manufacture of automobile bodies. Since one surface of the steel sheet material used for automobile and truck bodies generally has one side thereof painted or welded and the other side exposed to a highly corrosive environment and since a metallic zinc surface coating is not readily painted or weldable, it has been found desirable to provide one surface of a zinc coated steel strip with a surface which is free of metallic zinc. It has previously been disclosed that converting a zinc surface coating into an iron containing alloy coating improves the paintability and weldability thereof. Processes for producing galvanized ferrous metal sheet material having at least one side formed with an iron containing alloy surface coating are shown in U.S. Pat. Nos. 4,171,391; 4,171,394; and 4,120,997.

In order to produce a galvanized steel sheet having on at least one side a surface coating of an iron containing alloy it has heretofore been necessary to apply considerable energy in the form of heat to the galvanized surface in order to convert the zinc surface coating into an iron containing alloy surface coating. Also, the step of heating the zinc surface to form an iron containing zinc alloy surface coating has frequently been a limiting factor on the line speed in the process of producing a zinc-iron alloy coating on one-side only or on both surfaces of a galvanized ferrous metal strip. It is, therefore, highly desirable to reduce the amount of thermal energy and time required to convert a metallic zinc coating on one surface of a ferrous metal strip into an iron containing alloy surface coating so that there is no unalloyed metallic zinc remaining in the surface of the coating while at the same time avoiding forming an excessively thick brittle subsurface zinc-iron alloy layer on the other surface of a galvanized ferrous metal strip.

The present invention provides a means for economically processing a ferrous metal sheet or strip having on at least one side a metallic zinc surface coating so as to transform the zinc coating into an iron containing alloy surface coating which does not contain free metallic zinc in the surface thereof, and the present invention will be understood from the following detailed description and claims when read in conjunction with the accompanying drawing wherein:

Figure 1:
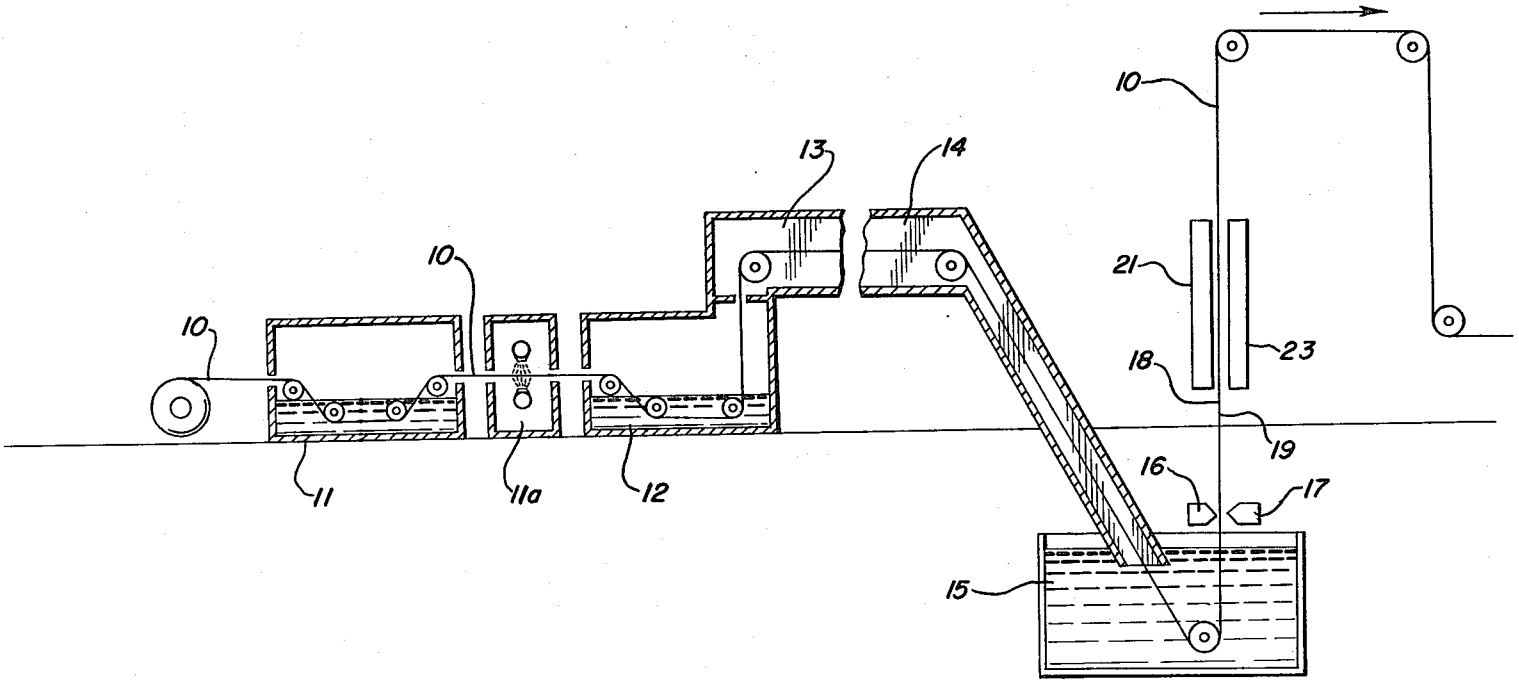
FIG. 1 is a schematic flow diagram of one embodiment of the applicant's process of producing more economically a ferrous metal strip having on at least one side a surface coating formed of zinc-iron alloy.
Figure 3:
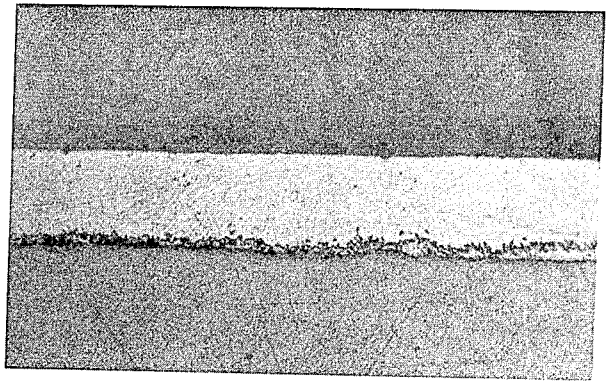
FIG. 3 is a photomicrograph of a rimmed steel strip which has been surface treated according to the present invention followed by processing on a continuous Sendzimir-type hot-dip galvanizing line in which the strip was heated to a temperature of 538° C. (1000° F.) and hot-dip galvanized under the identical conditions used for coating the strip of FIG. 2.
Figure 5:
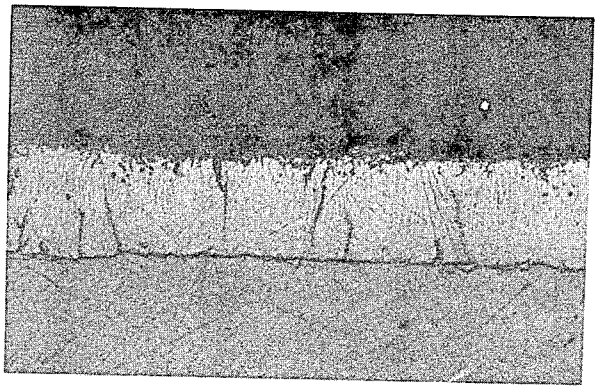
Figure 4:
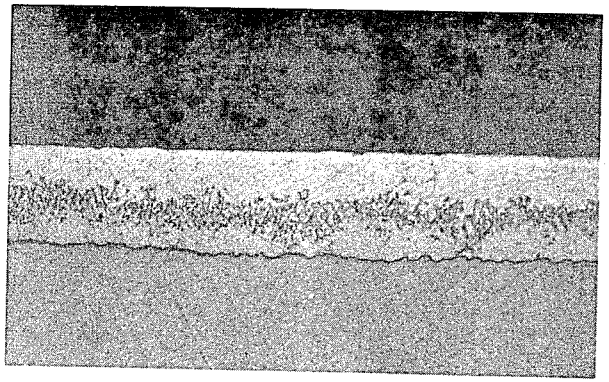

FIG. 4 is a photomicrograph of a rimmed steel strip surface treated according to the present invention and heated to a temperature of 927° C. (1700° F.) before hot-dip galvanizing in the same manner as in FIG. 3; and FIG. 5 is a photomicrograph of a rimmed steel strip surface treated and hot-dip galvanized as in FIG. 4 followed by further heating after withdrawing the strip from the hot-dip galvanizing bath to effect transforming any metallic zinc remaining in the coating into a zinc-iron alloy coating.

It has been discovered that the rate of diffusion of iron from a ferrous metal base into a zinc hot-dip coating (i.e. the zinc-iron alloy growth rate) can be very significantly increased and thereby significantly reduce the amount of heat required to transform a metallic zinc coating of a given thickness into a surface coating which is entirely free of metallic zinc by subjecting a ferrous metal strip after surface cleaning and before hot-dip coating to a pregalvanizing surface treatment which comprises applying an ultra thin flash film or coating of metallic copper to the clean ferrous metal surface of the strip and thereafter heating the copper coated strip to a temperature of between about 704° C. (1300° F.) and 927° C. (1700° F.) in a non-oxidizing atmosphere, such as a reducing atmosphere conventionally used in a Sendzimir-type process for preparing a strip for hot-dip coating. The strip is then preferably cooled to about the temperature of the hot-dip coating bath before immersing the strip in the hot-dip coating bath. When a ferrous metal strip pretreated in the above manner is immersed in a hot-dip zinc coating bath an intermetallic zinc-iron alloy layer is formed at a substantially greater rate than when the strip has not received a flash coating of metallic copper and heated to a temperature of between about 704° C.–927° C. (1300° F.–1700° F.). Thus, less heat is required to effect the complete alloying of the metallic zinc in the hot-dip zinc coating. And, when alloying very thin metallic zinc coatings, it is unnecessary to apply additional heat to the hot-dip coated strip after the strip is withdrawn from the hot-dip coating bath in order to avoid having unalloyed metallic zinc in the surface of the coating.

The metallic copper flash coating can be applied during the pretreating process in any manner desired, such as by electroplating with any commercial copper plating solution or simply by continuously passing a clean endless ferrous metal strip through a tank containing an aqueous acidic solution of copper sulfate, copper chloride or other water soluble copper salt where both surfaces are to have a flash copper coating formed thereon by displacement of iron, by roll coating one or both surfaces with the copper solution or by vapor deposition. In a hot-dip galvanizing process where the ferrous metal strip has a line speed which will allow the strip to remain in contact with an acidic copper sulfate aqueous solution at room temperature for a period of between 4 and 10 seconds, a satisfactory flash copper coating is provided by a copper sulfate solution which contains between about 7.5 to 15 grams per liter copper sulfate (0.03–0.06 moles) with the solution being acidified with from about 13 to 26 grams per liter (0.13–0.26 moles) concentrated sulfuric acid.

When the surface of a ferrous metal strip is contacted by an aqueous acidic solution of a copper salt of the foregoing type, a film of metallic copper is rapidly deposited on the surface of the ferrous metal strip by displacement of ferrous metal ions without requiring the application of any external electromotive force. The thickness of the metallic copper film formed will vary directly with the concentration of the copper salt solution, the length of time the strip remains in contact with the aqueous copper solution and on the acidity of the solution. The thickness of the metallic copper film deposited on the surface of the clean ferrous metal strip preferably should range between $1\times10^{-6}$ inches (25 mg. per $ft^2$) and about $4\times10^{-6}$ inches (100 mg per $ft^2$) when the strip is heated in a non-oxidizing atmosphere to a temperature between about 704° C. (1300° F.) and about 927° C. (1700° F.) prior to hot-dip coating. Where the strip can be heated to a temperature at the upper end of the foregoing temperature range (704° C.–927° C.), it is preferable to use a copper film thickness at the upper end of the thickness range specified.

Following the application of the thin metallic copper film on the clean surface of the ferrous metal strip and before applying a surface coating of hot-dip zinc thereover, the strip is heated in a non-oxidizing atmosphere to a temperature within a temperature range of about 704° C. and 927° C. (1300° F.–1700° F.) and preferable to about 927° C. (1700° F.).

In order to achieve the desired improvement in the rate of diffusion of iron into the metallic zinc coating the copper film should form a diffused copper-iron coating on the strip while retaining a surface film formed essentially of metallic copper. Thus, in each instance the thickness of the film of metallic copper, the temperature to which the copper film is heated and the duration of the heating are coordinated so that a thin film of metallic copper remains on the surface of the strip while a portion of the metallic copper is diffused into the ferrous metal strip. Since the thickness of the metallic copper film required is relatively thin, however, the time required to form a suitable metallic copper film in accordance with the present invention does not limit the line speed of a conventional commercial Sendzimir-type continuous galvanizing line.

After applying a hot-dip coating by any suitable galvanizing process over the copper film on at least one surface of the strip, it is generally necessary to pass the strip through a heating zone in which at least one of the surfaces of the strip is heated sufficiently to cause iron to diffuse throughout at least one of the zinc coatings and transform the metallic zinc coating into a zinc-iron alloy coating so that no unalloyed metallic zinc remains in the surface of the coating. When the alloying of a galvanized coating is complete, the iron concentration in the coating will range between about 6% and about 12% on a wt. basis.

Where the final product desired is a galvanized ferrous metal strip having a surface coating free of metallic zinc on only one side and a surface coating of metallic zinc remaining on the opposite side, the strip preferably is differentially hot-dip coated, since after hot-dip coating the thinner zinc coating can be transformed into the desired zinc-iron alloy surface coating without further heating or with only a moderate degree of heating and without causing the heavier zinc coating on the opposite side to be completely alloyed or have an excessively thick subsurface intermetallic zinc-iron alloy layer formed thereon. The thin side coating of the differentially hot-dip galvanized strip is preferably wiped by means of a gas jet-type coating weight control means to a thickness of about 0.2 mils or less to insure forming a uniform zinc-iron alloy coating. When a hot-dip galvanized coating is wiped to a thickness of about 0.1 mil, it has been found possible to form the desired alloy coating without further heating of the strip after the strip is withdrawn from the hot-dip galvanizing bath.

In addition to controlling the galvanized coating thickness, it is advisable to control the aluminum content of the coating bath in order to efficiently convert a thin zinc coating into the desired alloy surface coating without forming an excessively thick zinc-iron intermetallic alloy coating on the opposite heavier zinc coated side of the strip. A conventional galvanizing coating bath will contain between about 0.18–0.20 wt. percent aluminum in order to inhibit the formation of a thick zinc-iron intermetallic alloy layer between the surface of the strip and the surface layer of metallic zinc. When it is desired to convert at least one of the zinc coating into an alloy surface coating, the aluminum content of the coating bath is reduced to between about 0.10 to 0.16 wt. percent aluminum, and preferably to about 0.14 wt. percent aluminum. When the hot-dip coating bath has an aluminum content of 0.14 wt. percent aluminum, a thin zinc coating on a steel strip treated in accordance with the present invention can be rapidly converted to an alloy coating without forming a thick subsurface zinc-iron alloy coating on the opposite side of the hot-dip coated strip and without requiring any major alterations in the operating conditions of a conventional Sendzimir-type continuous galvanizing line.

With the reduced heat requirement for alloying the zinc coating on a steel strip which has been treated in accordance with the present invention, there is also greater leeway in controlling the operating conditions which reduces the likelihood of overheating the zinc coatings and causing over-alloying or decomposition of the zinc-iron alloy which can result in producing areas of unalloyed metallic zinc forming on the surface of the thin side alloy coating or cause alloying of the heavier zinc coating on the opposite side of the strip.

When producing a galvanized strip with only one side having an iron-containing alloy surface coating and the other side having a metallic zinc surface, the side of the strip opposite the surface being heated to effect alloying can be cooled by directing jets of cooling gas onto the surface of the strip in the area directly opposite the area being heated and maintaining a proper balance between the heat input and the cooling so as to convert the zinc coating on one side of the ferrous metal strip into the desired alloy surface coating while holding to a minimum the thickness of the subsurface intermetallic zinc-iron alloy layer formed between the surface of the ferrous metal strip and the zinc surface coating on the opposite side of the strip.

Where the galvanized ferrous metal strip must have an alloy surface coating on both sides of the strip, the strip can have surface coatings of zinc of substantially the same coating weight on both sides in which case both surfaces are exposed to the same pretreatment before hot-dip coating and, if required, to the same heat treatment after being hot-dip galvanized. If desired, however, the strip can be differentially zinc coated and the thickness of the metallic zinc coatings applied to the opposite zinc surfaces can be adjusted to the level required to effect forming the alloy surface coatings on, the thinner zinc coating side without the necessity of heating the thin zinc coating following hot-dip coating.

The thinner zinc coating or film on one surface of a differentially hot-dip coated steel strip which has been pretreated in accordance with the present invention in one embodiment of the present invention can be converted into a zinc-iron intermetallic alloy coating while leaving the heavier zinc coating on the opposite side of the strip in a formable condition, by continually passing the coated steel strip through a heating zone, immediately after it is withdrawn from a continuous hot-dip galvanizing bath and has passed between impinging gas jet coating weight control means but before the thinner zinc coating has solidified. The heating zone in one form comprises a chamber which has heating means mounted on at least one lateral surface disposed in a plane parallel to the plane of the strip so as to heat at least the surface of the strip to be alloyed and preferably providing means to simultaneously cool the opposite surface of the strip.

The metallic zinc coating which is to be alloyed should be heated sufficiently to transform the metallic zinc into a coating of substantially the same thickness containing zinc and iron alloyed in a minimum ratio of the zinc-iron intermetallic alloy composition $FeZn_{13}$ corresponding to about 6 wt. percent iron and generally in the ratio of the intermetallic alloy composition $FeZn_7$ which corresponds to an iron content of 12% by wt. iron. No heat in excess of the amount required to provide the desired intermetallic alloy coating should be applied to the thin zinc coated surface of the strip. Any excess heat would tend to increase the thickness of the subsurface intermetallic layer on the opposite side of the steel strip when only one side is being alloyed.

Where it is necessary to heat the hot-dip coating after the strip is withdrawn from the galvanizing bath to convert unalloyed zinc remaining in the coating to an iron-zinc alloy coating, the temperature to which the thin zinc coating is heated in order to provide the desired zinc-iron intermetallic alloy coating depends on the thickness of the strip being coated, the thickness of the zinc coating being alloyed and the time at which the coating can be maintained in the alloying heating zone without changing significantly the operating conditions of the coating line or equipment. The temperature required varies inversely with the length of time the strip is maintained at the elevated temperature in the heating zone. Since the thin zinc film is preferably kept in a molten state during the process to accelerate the transformation into an iron alloy coating, the lowest temperature of the strip in the heating zone should be somewhat above the melting point of the zinc coating material which is conventionally about 464° C. (850° F.). The maximum temperature at the surface of the strip as measured from the unheated side as the strip passes through the alloying heating zone is about 510° C.–538° C. (950° F.–1000° F.) with the strip temperature being measured at the exit end of the heating zone. It is preferable to maintain a temperature of the strip in the heating zone at about 482° C. (900° F.).

When the galvanizing line is operated at line speeds of between about 150 and 300 feet per minute which is well within the limits of economical operation of modern continuous galvanizing lines, the strip can remain within an alloying heating zone between about 3 to 10 seconds. The residence time of the strip in the alloying heating zone or chamber required to heat the strip to within the above specified temperature range is between about 3 to 5 seconds. The residence time of the strip in the heating zone, however, can be varied by changing the line speed of the strip, with the maximum line speed being limited by the heating capacity of the furnace. As the line speed is increased the dwell time of the strip in the furnace is reduced and the rate of heating the strip in the furnace chamber must be increased proportionately in order to effect complete transformation of all the zinc in the light weight coating into the desired zinc-iron intermetallic alloy coating. The amount of heat required to convert a metallic zinc coating of a given thickness into a coating which does not have unalloyed zinc in the surface is much less for a strip treated in accordance with the present invention than in any previous process of forming a zinc-iron alloy surface coating.

Any conventional type of heating elements can be used in the alloying heating zone, such as a plurality of jets adapted to burn liquid or gaseous fuels fired directly into the heating zone and radiant tubes or induction heating elements can be used. A suitable heating means can comprise a modified conventional continuous coating line gas heating furnace which is conventionally used for heating both surfaces of a moving steel strip with gaseous or liquid fuel jets and comprising a box-like structure lined with insulating material and provided with a bank of gas jets facing one side of the strip and having a bank of air jets on the opposite lateral surface thereof connected with a source of ambient air under pressure adapted to discharge air onto the zinc coating on the surface of the steel strip. Care should be taken to avoid having the heated gas stream or the air streams disturb the molten zinc films on the steel strip.

To more specifically illustrate the process of the present invention a low carbon cold rolled galvanizing steel strip 10, such as a 1008 rimmed steel or an aluminum killed steel, having a thickness of about 0.89 mm (0.035 inches) is continuously cleaned by passing through an alkaline cleaning bath 11 and a rinse chamber 11*a*, and thereafter continuously immersed in a 0.2 molar aqueous copper sulfate solution 12 for a period of about 4 to 5 seconds to deposit a flash metallic copper coating having a thickness of about $7.9 \times 10^{-7}$cm ($2 \times 10^{-6}$ inch). Thereafter the strip is heated to a temperature of 927° C. (1700° F.) while traveling at a speed of about 1.42 m/sec. (280 ft. per minute) in a heating zone 13 under a reducing atmosphere. The strip 10 is then cooled in a cooling zone 14 to a temperature of about 493° C. (920° F.) before immersing in the hot-dip galvanizing bath 15 having a temperature of about 464° C. (850° F.). The zinc coating bath 15 has the following composition: 0.14 wt. percent aluminum, 0.03 wt.% iron, 0.02 wt.% lead, and 0.023 wt.% antimony with the balance being essentially zinc. The strip 10 is withdrawn from the coating bath 15 vertically upwardly between oppositely disposed gas-jet type coating weight control nozzles 16, 17 blowing jets of steam at a temperature of about 177° C. (350° F.) onto the opposite surfaces of the strip 10. The surface 18 of the strip which is to have a zinc-iron alloy surface coating is provided with a coating having a weight of about 27 g/m$^2$. The strip 10 at a temperature of about 427° C. (800° F.) is moved upwardly into a heating chamber 21 while the zinc coatings are still in a molten condition. The chamber 21 contains a plurality of gas jet burners adapted to heat the coating having a weight of about 27 g/m$^2$ and a zinc iron intermetallic subsurface layer formed during hot-dip coating of about 2.8 micrometers in thickness to a peak temperature of about 900° F. as measured at the exit end of the chamber on the unheated side of the strip by an Ircon temperature measuring device while the strip remains in the chamber 21 for a period of about 3.5 seconds (i.e. the dwell time of the strip in the alloying heating chamber). The opposite inner wall 23 of the furnace chamber 21 is preferably provided with a plurality of air jets adapted to blow ambient air at a temperature of about 16° C. (60° F.) onto the opposite side of the strip in the area directly opposite the surface being heated by the gas jets. The cooling jets are adapted to blow ambient air onto the strip at a rate of about 1.42 $m^3$ per seconds to 1.89 $m^3$ per seconds (2117 to 2817 cu. ft. per minute). After leaving the furnace chamber the strip is air cooled below the melting point of the hot-dip zinc coating.

Figure 2:
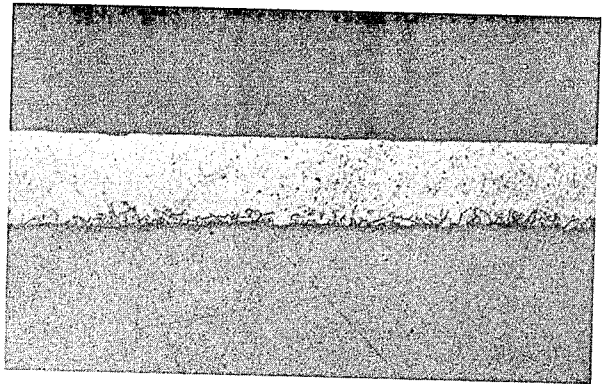
FIG. 2 is a photomicrograph of a rimmed steel strip processed on a continuous Sendzimir-type hot-dip galvanizing line wherein the strip was heated to a temperature of 927° C. (1700° F.) before being hot-dip galvanized.

FIG. 2 is a photomicrograph (500X) of a ferrous metal strip, such as 1008 rimmed steel strip having a clean surface which has not received a flash copper coating and which has been hot-dip coated on a Sendzimir-type continuous coating line in which the clean strip is heated to a temperature of about 927° C. (1700° F.) in a reducing atmosphere prior to cooling to about the temperature of the hot-dip coating bath and immersed for about 5 seconds in a hot-dip galvanizing bath having a temperature of 454° C. (850° F.) and containing 0.15 wt. percent A1. The photomicrograph shows the zinc-iron alloy layer which is formed has a thickness of about 0.05 mil ($50\times10^6$ inch).

FIG. 3 is a photomicrograph (500X) showing that a 1008 rimmed steel strip processed under the same conditions as in FIG. 2 except that the strip after having a flash copper coating applied as herein described is heated to a temperature of 538° C. (1000° F.) so that there is no significant diffusion of the copper coating into the steel surface. The zinc-iron intermetallic alloy layer formed during the hot-dip coating has a thickness of about 0.05 mil to 0.08 mil ($50\times10^{-6}$ inch to $80\times10^{-6}$ inch).

FIG. 4 is a photomicrograph (500X) showing that when the 1008 rimmed steel strip is pretreated in accordance with the foregoing description in which a flash copper coating is applied to the surface of the strip, the copper flash coating heated to a temperature of 927° C. (1700° F.) to effect diffusion of a portion of the copper coating into the steel and thereafter hot-dip galvanized under the same conditions as used for galvanizing the strip of FIG. 3, the zinc-iron alloy layer formed during the hot-dip galvanizing step has a thickness of about 0.4 mil ($400\times10^{-6}$ inch). From a comparison of FIGS. 3 and 4 it is evident that when the temperature to which the strip is heated is below the temperature at which a significant reaction between copper and aluminum occurs, there is no appreciable diffusion of copper into the base, and the rate of diffusion of iron into zinc is not significantly increased.

When the zinc coated strip of FIG. 4 is further heated after being withdrawn from the hot-dip zinc coating bath to transform the metallic zinc remaining in the hot-dip zinc surface coating completely into a zinc-iron alloy surface coating, a zinc-iron alloy surface coating containing at least about 6 percent iron is formed (see FIG. 5) with only about $\frac{1}{2}$ to $\frac{1}{3}$ the heat input as compared with the heat input required to convert all the metallic zinc in the coatings of the strip of FIGS. 2 into an identical zinc-iron alloy surface coating containing about 6 percent by weight iron. Moreover, where only a very thin zinc-iron alloy surface coating is required, it is possible to form the very thin zinc-iron alloy surface coating without passing the strip into a heating zone after the zinc coated strip is withdrawn from the hot-dip coating bath by wiping the hot-dip zinc coating to a thickness of 0.1 mil or less.

It will be understood that the term "zinc coating" as used in the specification and claims includes a coating formed mainly from metallic zinc, but which can also include minor amounts of one or more other metals in solution therein, such as lead, antimony, iron, magnesium, and aluminum or other incidental impurities.

The terms "alloy surface coating", "iron containing alloy coating", "iron alloy surface coating", "iron-zinc alloy" or "zinc-iron alloy" coating when used in the specification and claims designates a coating containing at least about 6 percent by weight iron and preferably 12 percent by wt. iron with the balance being essentially zinc and which can contain minor amounts of additives which are incidental impurities or a metal used in a hot-dip galvanizing bath to improve the hot-dip coating, such as aluminum, iron, magnesium, lead, copper, and the like additives.

I claim:

1. A process of forming a zinc-iron alloy coating on at least one lateral surface of a ferrous metal strip which comprises; applying a coating of metallic copper to at least one lateral surface of a clean ferrous metal strip, heating the strip in a non-oxidizing atmosphere to a temperature sufficient to effect diffusion of a portion of said copper coating into said strip while leaving a surface film of metallic copper on said one lateral surface, applying a coating of metallic zinc over at least said film of metallic copper, and heating said strip to transform said zinc coating on at least said one lateral surface into a zinc-iron alloy coating free of unalloyed metallic zinc in the surface thereof.

2. A process as in claim 1, wherein said coating of metallic copper is a displacement copper coating formed by contacting at least said one lateral surface of the ferrous metal strip with an aqueous acidic solution containing a water soluble copper salt.

3. A process as in claim 2, wherein said strip is immersed in said aqueous acidic solution to provide said coating of metallic copper on each lateral surface of said strip.

4. A process as in claim 1, wherein said coating of metallic copper is an electroplated copper coating.

5. A process as in claim 1, wherein said coating of metallic copper has a coating thickness of between about $1\times10^{-6}$ inch and $4\times10^{-6}$ inch, and said strip is heated in said non-oxidizing atmosphere to a temperature between about 705° C. (1300° F.) and 927° C. (1700° F.) to effect said diffusion of copper into said strip.

6. A process as in claim 1, wherein said strip has only one lateral surface thereof provided with a said coating of metallic copper.

7. A process as in claim 1, wherein said strip after application of said coating of metallic copper is processed on a continuous Sendzimir type hot-dip coating line.

8. A process as in claim 1, wherein said metallic zinc coating is formed by immersing said strip in a hot-dip galvanizing bath containing between about 0.10 to 0.16 wt. percent aluminum.

9. A process as in claim 8, wherein said bath contains 0.14 wt. percent aluminum.

10. A process as in claim 1, wherein said metallic zinc coating has a maximum thickness of about 0.2 mils.

11. A process as in claim 1, wherein at least said one lateral surface is heated after said strip is withdrawn from said hot-dip coating bath to effect transforming metallic zinc remaining in said coating into said zinc-iron alloy coating.

12. A process as in claim 1, wherein said ferrous metal strip is formed of rimmed steel.

13. A process as in claim 1, wherein said ferrous metal strip is formed of a killed steel.

14. A process as in claim 13, wherein said steel is an aluminum killed steel.

15. A process of providing a zinc-iron alloy surface coating on a zinc hot-dip coated ferrous metal strip without requiring heating the strip after withdrawing said strip from a hot-dip coating bath comprising; applying a coating of metallic copper to a clean lateral surface of a ferrous metal strip, heating said strip in a reducing atmosphere to a temperature between about 704° C. and about 927° C. (1300° F.–1700° F.) to effect diffusing a portion of said copper into said strip while leaving a film of metallic copper on the surface of the strip, immersing said strip in a hot-dip zinc coating bath to provide thereon a metallic zinc coating over said film of metallic copper, controlling the thickness of said metallic zinc coating to a maximum thickness of about 0.1 mil as said strip is withdrawn from said bath, and allowing the zinc coated strip to cool to ambient temperature without further heating said strip; whereby all the metallic zinc remaining in said coating forms a zinc-iron alloy as said strip is allowed to cool to ambient temperature.

16. A process of increasing the zinc-iron alloy growth rate when hot-dip galvanizing a ferrous metal strip comprising; applying a coating of metallic copper to a clean lateral surface of a ferrous metal strip, heating said strip to a temperature between about 704° C. and about 927° C. (1300° F.–1700° F.) in a reducing atmosphere to effect diffusing a portion of said copper into said strip while leaving a film of metallic copper on the surface of said strip, thereafter immersing said strip in a hot-dip zinc coating bath to provide a metallic zinc coating over said film of metallic copper, heating said strip to alloy all the zinc applied over said film of metallic copper and thereby provide a zinc alloy surface coating on said ferrous metal strip.

* * * * *